US005641159A

United States Patent [19]

Greive et al.

[11] Patent Number: 5,641,159

[45] Date of Patent: Jun. 24, 1997

[54] SYNCHRONIZING ROLLER ARRANGEMENT FOR TRANSPORTING SHEETS INTO A SHEET-PROCESSING MACHINE

[75] Inventors: Martin Greive, Heidelberg; Günter Zobl, Nussloch, both of Germany

[73] Assignee: Heidelberger Druckmaschinen AG, Heidelberg, Germany

[21] Appl. No.: 429,065

[22] Filed: Apr. 26, 1995

[30] Foreign Application Priority Data

Apr. 26, 1994 [DE] Germany ..... 44 14 445.8

[51] Int. Cl.[6] ..... B65H 5/02

[52] U.S. Cl. ..... 271/272; 271/273

[58] Field of Search ..... 271/11, 10.01, 271/12, 272, 273, 274

[56] References Cited

U.S. PATENT DOCUMENTS

| | | | |
|---|---|---|---|
| 1,910,506 | 5/1933 | Spiess . | |
| 3,210,074 | 10/1965 | Miaskoff | 271/273 |
| 3,993,302 | 11/1976 | Weisgerber . | |
| 4,163,550 | 8/1979 | Armstrong . | |
| 4,892,301 | 1/1990 | Barrois et al. . | |
| 4,951,062 | 8/1990 | Page et al. | 271/273 X |
| 4,979,730 | 12/1990 | Holbrook et al. | 271/273 X |

FOREIGN PATENT DOCUMENTS

| | | |
|---|---|---|
| 2103786 | 4/1972 | France . |
| 2027092 | 5/1972 | France . |
| 2318090 | 2/1977 | France . |
| 545921 | 2/1932 | Germany . |
| 830655 | 1/1952 | Germany . |
| 101641 | 11/1973 | Germany . |
| 3731216 | 7/1989 | Germany . |
| 1515443 | 6/1978 | United Kingdom . |
| 2120641 | 12/1983 | United Kingdom . |

*Primary Examiner*—David H. Bollinger

*Attorney, Agent, or Firm*—Herbert L. Lerner; Laurence A. Greenberg

[57] ABSTRACT

A synchronizing roller arrangement for transporting sheets into a sheet-processing machine, the synchronizing roller arrangement being mounted on a cyclically rotating shaft and pressable with adjustable contact pressure against a transport roller, and including a rotatably supported element, and a vertically-adjustable element whereon the rotatably supported element is secured.

9 Claims, 2 Drawing Sheets

SYNCHRONIZING ROLLER ARRANGEMENT FOR TRANSPORTING SHEETS INTO A SHEET-PROCESSING MACHINE

BACKGROUND OF THE INVENTION

1. Field of the Invention

The invention relates to a synchronizing roller arrangement for transporting sheets into a sheet-processing machine and, more particularly, such a synchronizing roller arrangement which is disposed on a cyclically rotating shaft and pressable with adjustable contact pressure against a transport roller.

In the case of a single-sheet feeder, the uppermost sheet of a sheet pile is gripped in a leading-edge region thereof by means of a suction bar, is separated or singled, is lifted between a synchronizing roller and a transport roller, and carried therefrom via a sheet guiding device to the grippers of a cylinder of the sheet-processing machine. The synchronizing roller arrangement is either a roller with a continuous shaft which carries rubber rings at defined spaced intervals thereon, or individual rollers which are rigidly secured to a cyclically rotating shaft. The cycling or clocking itself occurs in such a manner that the synchronizing roller assembly is slipped onto the transport roller, when the sheet is accepted or transferred from the suction bar, and is lifted from the transport roller, the instant that the grippers of the cylinder have gripped the sheet. This latter action means that the sheet can be freely entrained by the grippers.

To assure a problem-free transport of the sheets to the cylinder of the sheet-processing machine, the synchronizing rollers operate at a higher speed than the speed of the printing press. This increased speed is necessary so that the sheets can catch up with the gripper stops and thus be correctly aligned therewith.

For optimal sheet transport, the speed of the suction device and the speed of the transport rollers must be optimally coordinated with or adjusted to one another. Optimal sheet guidance can be attained only if the suction devices can pivot into the operating range of the synchronizing roller during the pivoting motion executed in the sheet feeding direction. If a continuous synchronizing roller is used, this is not possible so that, in such a case, it is impossible to assure optimal adjustment or coordination between the cycling or clocking of the suction devices and of the synchronizing roller.

In a printing press, sheets of different sizes or formats and of different quality are processed. To meet the various demands, it must be possible to set or adjust the synchronizing roller to the transport roller. If individual synchronizing rollers are used instead of a roller with a continuous shaft, a defined axial adjustment of the various synchronizing rollers must be required. Only in this way can the delivery of paper to the sheet-processing machine be attained with the requisite speed and the requisite accuracy.

SUMMARY OF THE INVENTION

It is accordingly an object of the invention to provide a synchronizing roller arrangement for transporting sheets into a sheet-processing machine which assures the feeding of sheets with varying properties to the sheet-processing machine.

With the foregoing and other objects in view, there is provided, in accordance with the invention, a synchronizing roller arrangement for transporting sheets into a sheet-processing machine, the synchronizing roller arrangement being mounted on a cyclically rotating shaft and pressable with adjustable contact pressure against a transport roller, comprising a rotatably supported element, and a vertically-adjustable element whereon the rotatably supported element is secured.

In accordance with another feature of the invention, the vertically-adjustable element is a spring plate having a predetermined bending line.

In accordance with a further feature of the invention, the vertically-adjustable element is formed of two levers resiliently connected to one another, the vertically-adjustable element being rotatably mounted.

In accordance with an added feature of the invention, the synchronizing roller arrangement is mounted displaceably on the shaft.

In accordance with an additional feature of the invention, the shaft is formed with detent indentations at defined locations thereon, and a snap-in locking mechanism corresponding with the detent indentations is included.

In accordance with yet another feature of the invention, the synchronizing roller arrangement includes a securing device having a pin pressable into a notch formed in the shaft for securing the synchronizing roller arrangement on the shaft, and a screw for pressing the pin into the notch.

In accordance with yet a further feature of the invention, the synchronizing roller arrangement includes a securing device for securing the synchronizing roller arrangement on the shaft, the securing device being a quick-action clamping device.

In accordance with yet an added feature of the invention, the rotatably supported element is a roller rotatably mounted in two bearing plates, and the vertically-adjustable element comprises a spring plate, the two bearing plates wherein the roller is rotatably mounted being coupled with the spring plate and being formed with a projection at a lower region of the bearing plates, the projection extending beyond the diameter of the roller.

In accordance with a concomitant feature of the invention, the rotatably supported element is disposed obliquely to a sheet feeding direction on the transport roller.

Thus, the object of the invention is achieved by providing that the synchronizing roller arrangement have a rotatably supported element which is secured to a vertically-adjustable element. In particular, the rotatably supported element may be a ball bearing with a spherical or cambered rubber coating or layer. Sheet transport can be optimized by making the coating of an elastic material having a high coefficient of friction. Moreover, the material should be wear-resistant and should have low ink receptivity. This latter factor is of great importance if sheets which have already been printed are to be transported.

All synchronizing rollers have a defined zero position. This is the setting in which the spherical rubber coating of the roll is so compressed that the diameter of the roll decreases a given amount. Depending upon the type of paper to be processed, the vertically-adjustable element is adjusted defined amounts.

An especially simple and economical construction provides for the vertically-adjustable element to be a spring plate with a predetermined deflection-curve bending line. The bending line of the spring plate is calculated so that the contact pressure can be varied within a defined range. In particular, this range is selected so that all of the types of paper to be handled can be transported into the printing press without problem.

In an alternative embodiment, the vertically-adjustable element has two levers, and the synchronizing roller is adjustable via a swivel or pivot point and a compression spring to the desired contact pressure. This construction is to be considered an equivalent construction to that of the prestressed spring plate.

In a sheet-processing machine, in particular a printing press, the most varied sizes or formats are printed. To meet these demands, the various synchronizing rollers are displaceably supported on the shaft. The capability of axially adjusting the synchronizing rollers may be highly advantageous if previously printed pieces of paper are to be resupplied to the sheet-processing machine. With this advantageous further feature of the invention, to prevent damage to the surface which has already been printed, the individual synchronizing rollers can be adjusted to print-free regions.

As mentioned hereinbefore, it is necessary for the suction devices to swing freely, at an optimal speed, through the operating range of the synchronizing roller. To prevent collisions with the suction devices, the synchronizing roller, in an advantageous further feature, is provided with detent indentations at defined locations on the shaft; at least one corresponding snap-in detent mechanism is also provided on each synchronizing roller. In the simplest case, the snap-in detent mechanism is a ball detent, which snaps into place at the location of the detent indentations, when the synchronizing roller is displaced.

The synchronizing roller or rollers are firmly joined to the shaft during sheet feeding. In an advantageous embodiment, the following provisions are made to provide a fast-release securing device for the synchronizing roller: a pin is pressed into a notch of the shaft by means of a capstan screw, at a location defined by the detent indentations.

Instead of the securing device described hereinabove, the synchronizing roller can also be fixed to the shaft via a fast-action clamping device. By means of a defined adjustment of the adjusting screw, the settings of the various synchronizing rollers to the transport roller can be accomplished in parallel and simultaneously. This is especially important because, only if there is a like contact pressure at all of the synchronizing rollers, can optimal sheet guidance be obtained. A scale which associates a defined vertical adjustment of the rotatably supported roller with a rotational angle of the adjusting screw is, for example, mounted on the adjusting screw. To fix the adjusting screw in a desired position, a detent element or a detent spring is provided.

In an advantageous further feature of the synchronizing roller arrangement according to the invention, both bearing parts wherein the rotatably supported roller is secured are formed so that they extend beyond the rubber coating in the lower region. This construction averts damage to the rubber coating when the synchronizing roller is displaced on the shaft and possibly strikes the edges of the sheet guiding device.

Special problems arise when thin sheets of paper are transported, because such sheets tend to crease, especially at high delivery speeds. To assure a non-creasing transport, a further advantageous feature of the invention proposes that the rotatably supported element or roller be mounted on the transport roller obliquely to the paper travel direction. As a result, a force is exerted upon the sheet transversely to the sheet feeding direction; in other words, the sheet is stressed outwardly. Purely constructively, the oblique position of the synchronizing roller can be attained by adjusting the spring plate obliquely to the sheet feeding plane.

Other features which are considered as characteristic for the invention are set forth in the appended claims.

Although the invention is illustrated and described herein as embodied in a synchronizing roller for transporting sheets into a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
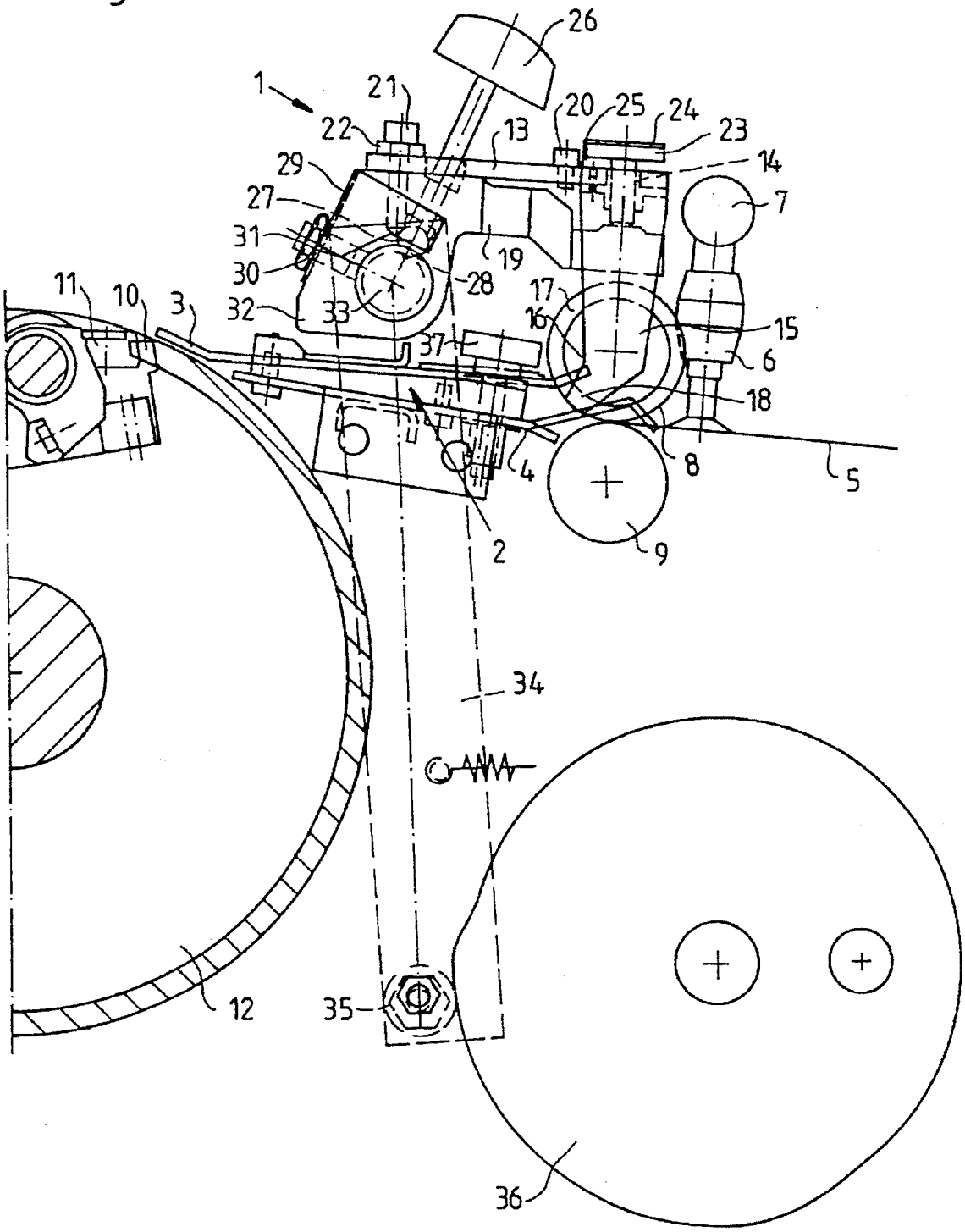
FIG. 1 is a cross-sectional view of a feeding region of a printing press, together with a diagrammatic side elevational view of a synchronizing roller arrangement according to the invention.

Referring now to the drawing and, first, particularly to FIG. 1 thereof, there is shown therein, in a sectional view, a feeding region of a printing press and, in particular, FIG. 1 shows, in a diagrammatic side elevational view, a synchronizing roller 1 according to the invention. An uppermost sheet 5 of an otherwise non-illustrated sheet pile is gripped at a region of a leading edge thereof by suction devices 6 disposed on a shaft 7, is separated or singled, and is guided by a swiveling or pivoting movement of the shaft 7 in a sheet feeding direction between the roller 8 of the synchronizing roller 1 and the transport roller 9. The cycling or clocking of the shaft 7 and the cycling or clocking of the synchronizing roller 1 are coordinated or adapted to one another so that the suction device 6 releases the sheet 5 at the latest at the reversal point in its swiveling movement. The roller 8 rolls along the transport roller 9 under contact pressure and thrusts or slides the sheet 5 against gripper stops 10 through a sheet guide 2 which is formed of an upper sheet guidance device 3 and a lower sheet guidance device 4. To achieve exact contact between the sheet 5 and the gripper stops 10, the sheet 5 is transported to the gripper stops 10 and is caused to bulge or belly out so that it becomes aligned accurately with the gripper stops 10. The instant the grippers 11 have engaged the leading edge of the sheet, the synchronizing roller 1 is lifted from the transport roller 9. Once the grippers have closed, the sheet 5 is thus entirely free and can be moved at machine speed. The grippers 11 and the gripper stops 10 are disposed in a conventional manner in a cylinder 12 of the sheet-processing machine which may be in the form of an otherwise non-illustrated printing press.

The synchronizing roller arrangement 1 is secured, via two bearing levers 19 and a securing mechanism 26, 27, 28, on a shaft 33 so as to be fixed against relative rotation. Essential components of the synchronizing roller arrangement 1 are a prestressed spring plate 13, an adjusting thread 14, and the roller 8 which is rotatable in bearing plates 15. The roller 8 is formed of a ball bearing 16, which has a rubber coating 17. To avoid damage to the rubber coating 17 due to possible collision thereof with edges of the upper guidance device 3, the bearing plate 15 is formed with a projection 18 in a lower region thereof. The spring plate 15 is connected at a front region thereof to the bearing levers 19 by two screws 21. An underlay or packing 22 assures a defined bending line for the spring plate 13. Above the center point of the roller 8, an adjusting thread 14 is provided in the spring plate 13. Via the adjusting screw 23, which carries a scale 24, the roller 8 can be adjusted in height, i.e., vertically, as viewed in FIG. 1, to a defined value.

As already mentioned hereinabove, the synchronizing roller 1 is fixed in a detent position of the shaft 33 by an adjusting mechanism. This adjusting mechanism includes a notch formation 28 in the shaft 33 and a cylindrical pin 27, which is pressed into the notch 28 by a capstan screw 26 of the aforementioned securing mechanism 26, 27, 28. A sheet-metal part 29, which is secured to the bearing levers 19 via a ball detent 31 and a nut 30, assures that the cylindrical pin 27 cannot fall out sidewise during the process of adjustment of the synchronizing roller 1.

At the beginning of the printing process, the synchronizing roller 1 is adjusted to the respective type of paper to be processed, i.e., the contact pressure between the rubber coating or layer 17 of the roller 8 and the transport roller 9 is selected in accordance with or as a function of the thickness of the sheets 5 to be transported. The respective optimal setting or adjustment in a given situation can easily be found using the scale 24 on the adjusting screw 23. The clocking or cycling of the synchronizing roller 1 or, in other words, the disengagement or stopping, and the pressing of the roller 8 against the transport roller 9, is effected in a conventional manner via a cam control. For this purpose, the shaft 33 is rigidly coupled with a lever 34. A roller 48 (FIG. 2), which rolls on a cam 36, is mounted on the lever 34 at a lower region thereof, as viewed in FIG. 1.

Figure 2:
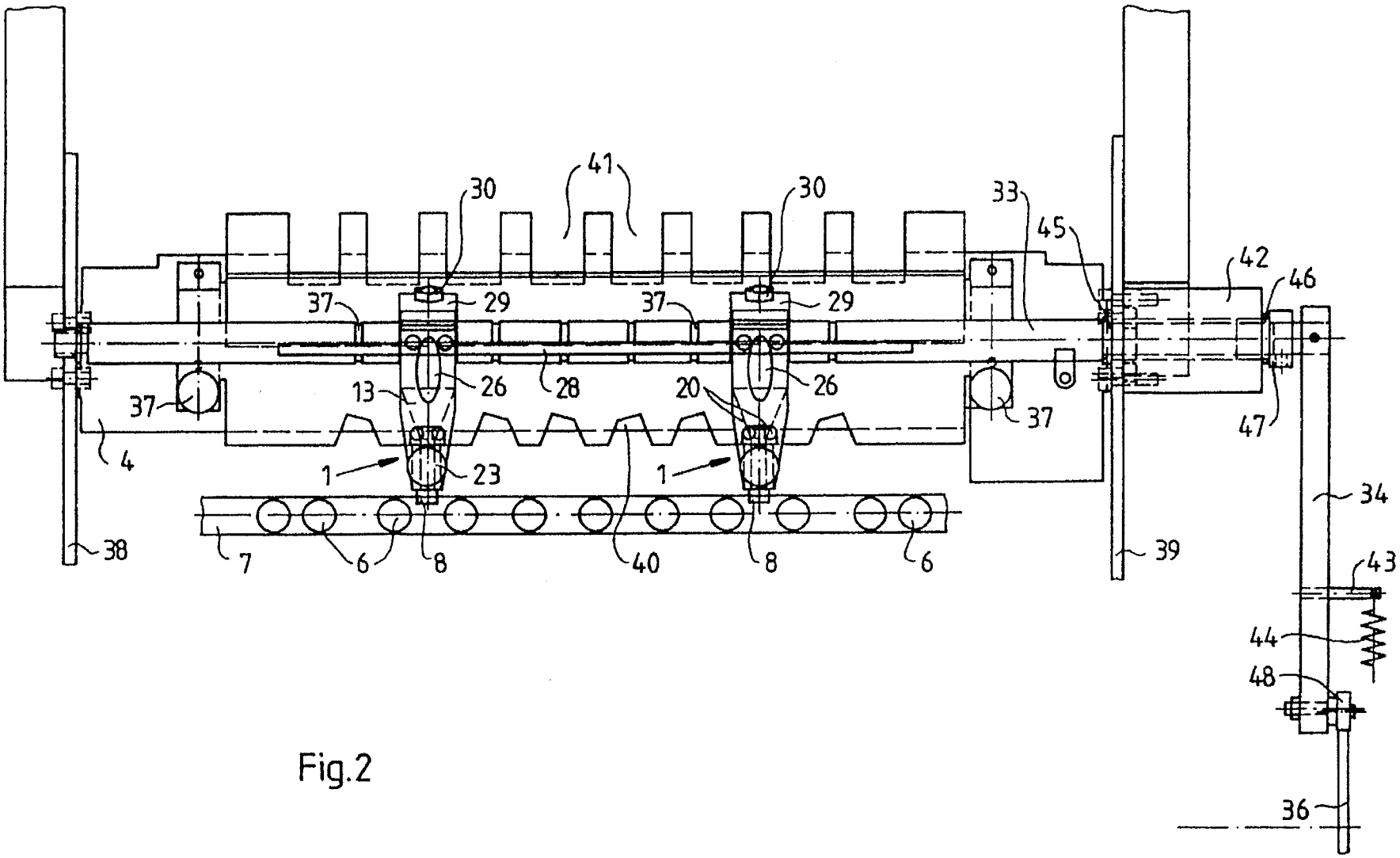
FIG. 2 is a top plan view of the synchronizing roller arrangement of FIG. 1.

FIG. 2 is a diagrammatic plan view of the arrangement of synchronizing rollers 1 according to the invention shown in FIG. 1. The lower sheet guidance device 4 is connected by suitable fastening means to side parts 38 and 39. The upper sheet guidance device 3 is screwed to this lower sheet guidance device 4. To permit a problem-free removal of the upper sheet guidance device 3 for cleaning purposes, the screws 37 are formed as knurled-head screws. The upper sheet guidance device 3 is formed with recesses 40 and 41, respectively, both in a forward and in a rearward region thereof. The grippers 11 engage in the recesses 41 in the forward or front region of the upper sheet guidance device 3. The recesses 40 in the rearward region of the upper sheet guidance device 3 provide space for the roller 8 of the synchronizing roller 1. Advantageously, edges of the upper sheet guidance device 3 defining the recesses 40 are beveled; this structural feature reduces the danger of the sheets 5 catching at the respective edges.

As described hereinbefore in conjunction with FIG. 1, the synchronizing rollers 1 are releasably secured to the shaft 33. The synchronizing rollers 1 are fixed, respectively, in the locations defined by the detent indentations 37 on the shaft 33. These locations are selected so that they are staggered in gaps between the suction devices 6 which, in turn, are secured on a separate shaft 7. Due to this special arrangement, collision of the suction devices 6 with the roller 8 of the synchronizing roller arrangement 1 is avoided in every operating condition.

To adjust the synchronizing rollers on the shaft 33, the capstan screw 26 is loosened; then, the synchronizing roller 1, by being swiveled or pivoted slightly, is lifted at a rear region thereof in such a manner that it does not collide with parts of the upper sheet guidance device 3. The pivoting of the synchronizing roller 1 is limited by a projection 32 in the forward region of the bearing lever 19.

A journal for the shaft 33 is mounted at the operator's side in the side part 38 of the press. An the drive side, the shaft 33 is guided through the side part 39 of the press and mounted in a bearing part 42. A displacement of the shaft 33 in axial direction is prevented by a stop 45 and an adjusting ring 47. On the drive side, the shaft 33 is mounted in a journal which is rigidly connected to a lever 34. A cam roller 48 is screwed onto the lever 34 in a lower region thereof. Via the spring 44 and the lever 34, the cam roller 48 is positioned against the cam 36.

We claim:

1. A cycled roller arrangement for transporting sheets into a sheet-processing machine, the cycled roller arrangement being mounted on a cyclically rotating shaft and having a device for pressing the cycled roller arrangement with adjustable contact pressure against a transport roller, comprising a rotatably supported element, and a vertically-adjustable element whereon said rotatably supported element is secured.

2. The cycled roller arrangement according to claim 1, wherein said vertically-adjustable element is a spring plate having a predetermined bending line.

3. The cycled roller arrangement according to claim 1, wherein said vertically-adjustable element is formed of two levers resiliently connected to one another, said vertically-adjustable element being rotatably mounted.

4. The cycled roller arrangement according to claim 1, wherein the synchronizing roller arrangement is mounted displaceably on the shaft.

5. Roller arrangement according to claim 4, wherein the shaft is formed with detent indentations at defined locations thereon, and including a snap-in locking mechanism corresponding with said detent indentations for locking the cycled roller arrangement at the defined locations relative to the shaft.

6. The cycled roller arrangement according to claim 5, including a securing device having a pin pressable into a notch formed in the shaft for securing the synchronizing roller arrangement on the shaft, and a screw for pressing said pin into said notch.

7. The cycled roller arrangement according to claim 5, including a securing device for securing the synchronizing roller arrangement on the shaft.

8. The cycled roller arrangement according to claim 1, wherein said rotatably supported element is a roller rotatably mounted in two bearing plates, and wherein said vertically-adjustable element comprises a spring plate, said two bearing plates wherein said roller is rotatably mounted being coupled with said spring plate and being formed with a projection at a lower region of said bearing plates, said projection extending beyond the diameter of said roller.

9. The cycled roller arrangement according to claim 1, wherein said rotatably supported element is disposed transversely to a sheet feeding direction on the transport roller.

* * * * *